United States Patent [19]

Young

[11] 4,377,749

[45] Mar. 22, 1983

[54] PHOTOIONIZER

[76] Inventor: Robert A. Young, 10658 Fullbright Ave., Chatsworth, Calif. 19311

[21] Appl. No.: 238,275

[22] Filed: Feb. 25, 1981

[51] Int. Cl.[3] ..... H01J 39/34

[52] U.S. Cl. ..... 250/423 P

[58] Field of Search ..... 250/423 P, 281, 282, 250/428 R; 313/184

[56] References Cited

U.S. PATENT DOCUMENTS

| | | | |
|---|---|---|---|
| 3,476,968 | 11/1969 | Omura | 250/423 P |
| 3,478,204 | 11/1969 | Brubaker et al. | 250/423 P |
| 4,000,420 | 12/1976 | Harris | 250/423 P |

*Primary Examiner*—Bruce C. Anderson

*Attorney, Agent, or Firm*—John E. Benoit

[57] ABSTRACT

There is provided a photoionizer which includes a light source comprising a hollow torus, an ultraviolet transmitting window substantially surrounding a passage through the torus, a gas filling within the torus, and means for creating an electrical discharge within said torus. The photoionizer further includes an electrode means within said passage through said torus for collecting, or extracting, the ions produced by the said light source striking a gas within said passage, means for passing a preselected gas sample through said passage containing said electrode means, and means connected to said electrode means for measuring the ions collected by said electrode means resulting from the interaction between said light source and said gas sample or extracting means able to project a beam of ions from the ionization region or from an ion image outside the ionization region.

44 Claims, 6 Drawing Figures

PHOTOIONIZER

The present invention relates generally to a photoionizer and more specifically to a photoionization detector of trace species which uses a sealed light source in the detector and a photoionization source for a mass spectrometer which uses the same light source.

BACKGROUND OF THE INVENTION

The use of sealed light sources for various purposes is discussed and illustrated in U.S. Pat. Nos. 3,902,064, 3,902,808, 3,904,907, 3,946,235, 3,946,272, 3,984,727, 4,002,922 and 4,024,131 as well as other patents which all issued in the name of the present inventor. Reference is hereby made to these patents for background information relative to the basic operation of such lamps.

In the present invention, the type of lamp generally shown in the above-identified patents is modified so that the central hollow dielectric electrode which has one end enclosed is modified to extend completely through the lamp bulb. Accordingly, the front window which exists in the referenced patents is not used in the present invention. It is effectively replaced by a cylindrical window which will be described below. In the present application, the use of the word "torus" will be basically understood from the dictionary definition which refers to the surface of a solid shape which is normally formed by a revolving plane closed curve about a line in its plane. The structure forming the torus may be shaped by continuous (but not uniform) deformation such that it can be transformed into a torus whose enclosed cross section can be outlined by any plain curve, with or without a tube connecting to the inner wall of the torus.

BRIEF DESCRIPTION OF THE INVENTION

Figure 1:
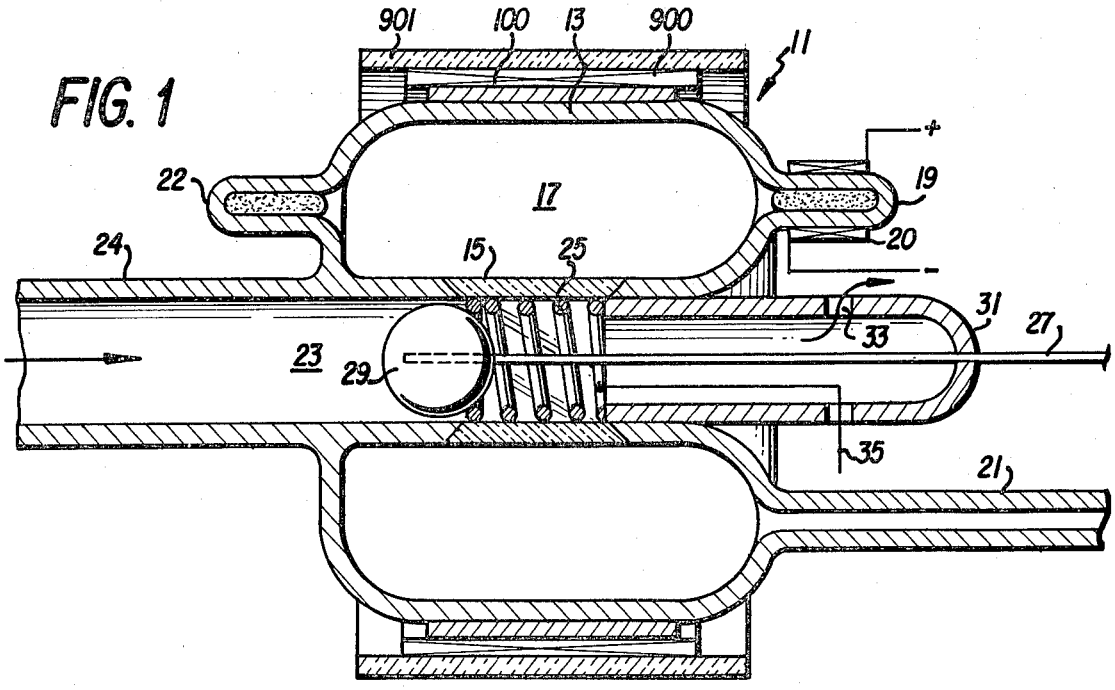
FIG. 1 is a schematic illustration of one embodiment of the invention.

The present invention provides a photoionizer which includes a light source comprising a hollow torus, an ultraviolet transmitting window substantially surrounding a passage through the torus, a gas filling within the torus, and means for creating an electrical discharge within said torus. It further includes an electrode means within said passage through said torus for collecting, or extracting, the ions produced by the said light source striking a gas within said passage, means for passing a preselected gas sample through said passage containing said electrode means, and means connected to said electrode means for measuring the interaction between said light source and said gas sample or extracting means able to project a beam of ions from the ionization region or from an ion image outside the ionization region.

Electrodes occur in pairs between which a potential difference is applied. In one case, an AC potential difference is applied to cause a discharge in the gas in the photoionization light source and in another case, a stable, or slowly varying, potential (relative to that causing a discharge) is applied to electrodes to collect or extract ions from a region near the light source window. These electrodes may be physically different, or one electrode of the AC potential pair may be composed of a physically distant pair between which a stable or slowly varying potential is applied while both are at nearly the same AC potential. In addition, the electrodes may perform other functions such as securing the light source or heating the light source.

The photoionizer is operated in two modes; (1) when the gas sample being ionized is at hight density so that the resulting ions have a mean free path smaller than a typical dimension of the ionization region, and (2) when the gas pressure is small such that the ion mean free path is large relative to a typical dimension of the ionization region. Ions are collected at high sample pressure and the device is used to measure the amount of parent gas in the sample from which ions are made by photoionization. At low pressure, the ions are extracted from the ionization region and projected or focused through an aperture for analysis and measurement as by a mass spectrometer or other means.

In the use of this photoionizer, it is essential that ionizable species be introduced into the ionizing region. Some of these species, both in their natural and ionized form, become attached to the surface of the ionizer and its electrode structure. Often these react to form more complex species (such as crosslinked polymers), which are not subsequently released and flushed out of the ionizer. These residues form films which absorb the photoionization light and insulate the conducting surfaces of the electrodes. Both are undesirable, because they decrease the efficiency of the ionizer and increase its instabilities.

These films are often insoluable in ordinary solvents and are difficult to remove. However, they do react with free radicals such as O, $O_3$, H, OH, and others to form various gaseous products. In this way, complex hydrocarbons are removed as CO, $CO_2$, OH, etc. when O is present and as CH, $CH_2$, $H_2$, etc. when H is present.

The free radicals O, and H are easily produced by photolysis of oxygen and $H_2O$ by the photoionization radiation from the lamp, or by an electrical discharge produced in the gas which flows through the ionization region. Special provision can be made for this to occur by properly placing electrodes in or near the gas in the ionization region and by adding special cleaning gases containing $O_2$ and/or $H_2O$ as other simple compounds which will break down into free radicals.

To insure that the free radicals react with the surface films, it may be required to reduce or increase the density of the gas in the ionization region or to dilute the species from which radicals are generated with a nonreactive gas, such as a rare gas.

There are occasions when the ionizable constituents (or other species associated with these ionizable constituents) have a low vapor pressure. To prevent them from condensing on the elements of the ionizer, the elements must be heated, perhaps to 300° C. This can be accomplished by utilizing some of the electrodes already present or by mounting the ionizer within a heated and thermally insulated region. Provision for this is also made without interfering with the normal operation of the ionizer.

It is imperative that only photoionization occurs in the region from which ions are extracted or collected. To insure this, there must not be large fields in this region. The DC, or slowly varying ion collection potentials are, hence, small enough such that electrons or ions produced by photoionization are not accelerated to high enough energy to cause additional ionization by collision. When the ion collection electrodes are also used as the high voltage AC electrode for causing a discharge in the torus, it is essential that they be at the same high AC potential so as not to cause a large field inside the ion collection region. In addition, these electrodes must be so located near the dielectric envelope and far from other electrodes near the photoionization region, that the high AC fields are located inside the torus or in a region outside that from which ions are collected.

DETAILED DESCRIPTION OF THE INVENTION

Turning now more specifically to the drawings, there is shown in FIG. 1 lamp 11 consisting of a torus 13 as defined and having a UV or VUV transmitting window 15 which is part of the central inner wall of the torus. The torus is hollow and includes a gas filling 17 and may have a gas source side arm 19 with an associated heating means 20 and a second side arm 22 containing a gettering material. There is also shown a pump stem 21 which is used to fill the torus with the particular design gas filling and which is subsequently sealed off after such filling process is complete.

If required, heater 900 in conjunction with insulation 901 can be used to maintain the ionizer at an elevated temperature.

In the embodiment shown in FIG. 1, a passage 23 is created by means of molding a wall 24 so as to conform to the inner passage of the torus. As shown, UV or VUV transparent material 15 is secured so as to form a section of the inner wall of the torus. Electrode structure 25, consisting of a cylindrical metal element, is secured adjacent said transparent material and is designed so as to have many openings. Element 25, as shown in the embodiment in FIG. 1, is a helical spring. However, it should be noted that a metal mesh could be used as well as a deposited electrode structure. Such structure will be referred to hereinafter as a semi-transparent electrode.

A thin central electrode 27 passes centrally through the passage 23 and is substantially aligned in the axis of such passage. The two electrodes 27 and 25 are electrically insulated from one another.

In the embodiment shown in FIG. 1, electrode 27 is maintained in the passage by means such as a glass ball 29 in which the electrode 27 is imbedded. Electrode 27 also passes through a spring compression unit 31 whereby the compression unit is adjusted within passage 23 so as to maintain the ball 29 nestled firmly against helical electrode 25 and also to maintain electrode 27 under tension. Spring compression unit 31 has passages 33 therethrough so that the gas may pass outwardly therefrom and, additionally, so that the outer electrode lead 35 may be passed outwardly from the detector. Electrode 100, in contact with the outer wall of the torus, holds the torus and is an electrical conductor at AC and DC ground.

This electrode structure has two functions: First, it acts as a high AC voltage electrode to cause a discharge, preferably in the range of 50 KHz and 5000 MHz, between electrode 25 and electrode 100 in the torus which surrounds it and, secondly, it collects positive ions on the central electrode which are formed in the gas passing through the passage 23 by optical radiation from the discharge in the torus.

Figure 2:
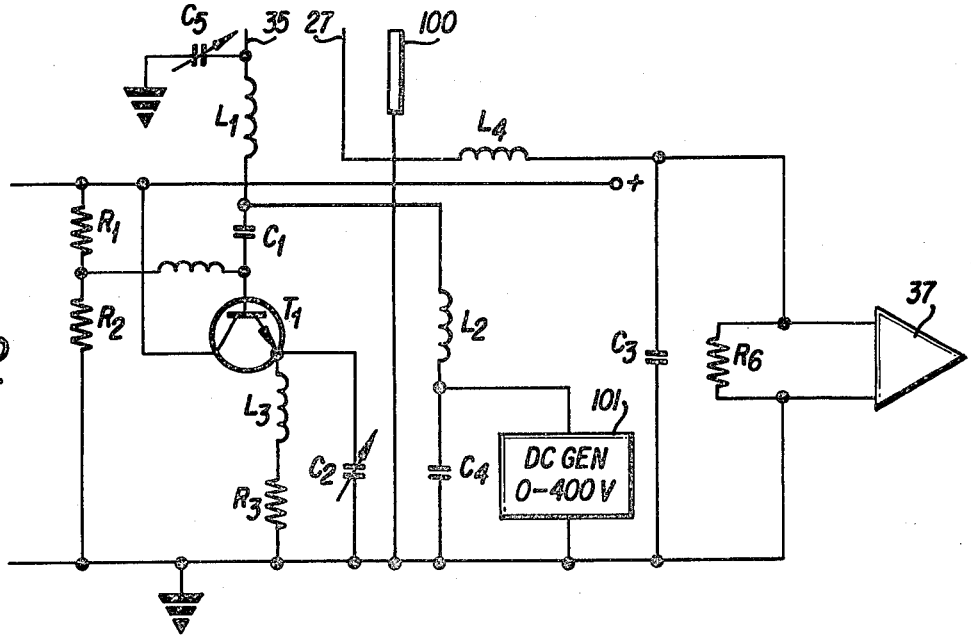
FIG. 2 is a schematic diagram of the detecting circuit used relative to the output of FIG. 1.

FIG. 2 illustrates the circuitry used for accomplishing this purpose. Outer electrode 25 is connected to an AC resonance circuit 35 comprised of capacitor C5 and coil L1 as is the standard procedure in the above-identified patents. In the present usage, the circuit is modified whereby DC decoupling capacitor C1 is used so that the outer conductor 25 and the series resonant circuit composed of C5 and L1 can have an arbitrary DC voltage impressed upon it. This is accomplished by DC voltage generator 101 together with coil L2 and capacitor C4 which, together with the use of capacitor C1, isolates the RF and DC circuits. Central electrode 27 is connected to an electrometer circuit 37 which includes resistor R6. This connection is made through coil L4, and the RF voltage is filtered out by coil L5 and capacitor C3. Positive ions are collected on the central electrode where they are neutralized by electrons which pass from ground through resistance R6 of the electrometer, with the electrometer measuring the current which equals the rate of positive ion collection by the central electrode and, thus, relates to the amount of the particular ionizable gas which is passed through passage 23.

An unwanted background is produced by electrons ejected from the conductive electrodes. Since the outer electrode is positive, any electrons ejected from it are collected by it and no current flows in the exterior circuit. However, electrons ejected from the negative central electrode move to the outer electrode and are therefore measured by the electrometer. This unwanted current may be minimized by making the central electrode wire as small as 0.001 inches in diameter so as to minimize the area from which electrons can be ejected compared to the volume of gas from which positive ions may be collected.

The above configuration of the torus and the arrangement of the electrodes together with the circuitry has the following advantages. (1) The UV or VUV radiation from the bulb which surrounds the ionization region is efficiently coupled into that region. (2) The volume of this region is all effectively used and can be made small. (3) Photoelectron currents are made small due to the small area of the negative electrode. (4) Excitation of the discharge is effective, as is ion collection, while both use some of the same electrode structure. (5) Gas passage through the ionization region is direct and simple.

The gas filling the torus can be varied according to particular requirements, one of which is the desired wavelength distribution of the radiation. It may contain at least one rare gas or at least two rare gases. Further, it may contain at least one rare and one halogen containing compound.

The material from which the torus is constructed is a dielectric such as glass quartz, purified $SiO_2$, Pyrex, or of an alkali metal resistant glass such as 1720 glass, 1723 glass and Gehlinite.

The window itself may be sealed to the torus by a sealing compound which may be selected from the list consisting of epoxy resins, Silvac or AgCl/Ag pair, or a low melting sealing glass.

Figure 3:
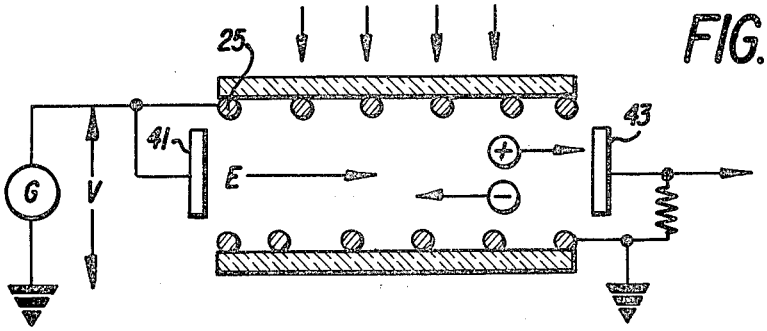
FIG. 3 is a schematic illustration of the interaction between the electrodes and the electric fields relating thereto.

Turning now to FIG. 3, there is shown a schematic illustration of the operation and the effects thereof within the passageway of the torus of a different electrode structure. The downward decending arrows indicate the discharge which occurs from the torus. A current generator G is connected to both the helical electrode 25 and, in this illustrative case, electrode 41. The resulting current in the helix establishes a uniform electric field along the axis of the electrode structure. This electric field causes the positive ions to pass in the direction as shown to the ground electrode 43 and the negative ions to pass in the reverse direction. The output from electrode 43 is connected to the electrometer. Accordingly, the resulting output to the electrometer will be indicative of the characteristics and the amount of the particular gas which is being examined. This usually is done at a high sample gas pressure. Electrodes 41 and 43 must permit gas to flow through them and, so, are of a mesh or grid structure.

If electrode 43 is as described, or is a ring or short cylinder adjacent to the torus wall, and the sample gas pressure is low, ions will be extracted from the ionization region and projected along the electrical system axis. If the electrode 43 is complex so as to form an ion lens, the ions will be formed into an image at some distant point.

Figure 4:
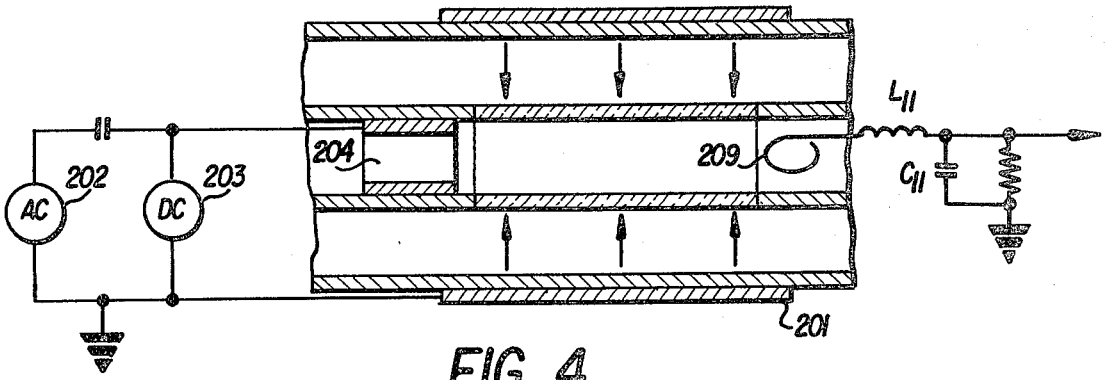
FIG. 4 is a schematic illustration of a modified electrode configuration.

FIG. 4 shows another and simpler electrode configuration. The discharge (vertical arrows) occurs between the outside ground electrode 201 and cylindrical electrode 204 when AC generator 202 is operating. When DC generator 203 applies a positive potential to electrode 204, positive ions are repelled to wire electrode 209 where they are collected and measured by an electrometer (not shown) after the AC signal is removed by coil L11 and capacitor C11.

There are several variations in the size, shape, and positioning of the ion collection electrodes. These variations are meant to facilitate manufacture or assembly, to reduce photoelectron currents from the electrodes, to optimize the discharge in the light source, to minimize interference of the AC potential in the measuring of the ion currents, or to optimize the extraction and/or focusing of ions from the ionization region.

Figure 5:
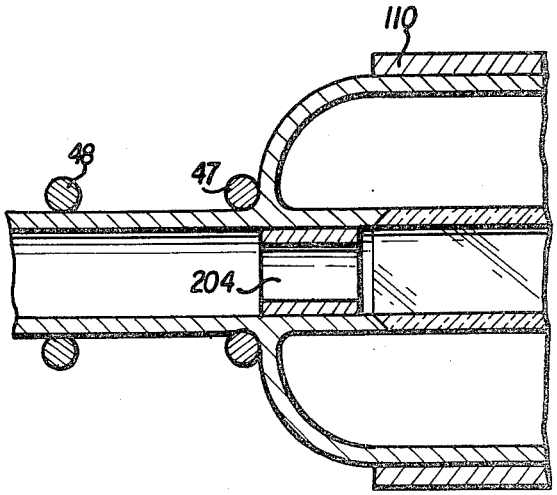
FIG. 5 is a partial cutaway schematic of a modification of the device of FIG. 1.

FIG. 5 shows a configuration in which the electrodes causing the discharge in the torus (47 and 110) are physically different from the electrodes (204, 209 or 41, 25 and 43) used for collection or extraction of ions from the region illuminated by the light source. In this case, there is less need for decoupling the ion collection potentials since they are coupled only indirectly by the capacitance between the separate electrode structures.

Electrode 47, in conjunction with one of the other electrodes, if it is grounded, can be used to cause a discharge inside the sample gas so as to create free molecules for cleaning deposits from surfaces. Additionally, a discharge can be generated between electrodes 47 and 48.

Figure 6:
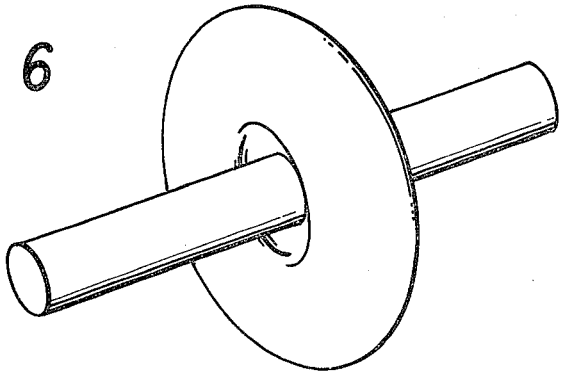
FIG. 6 is an illustration of a further shape which may be assumed by the torus of the present invention.

FIG. 6 illustrates one of the many configurations which the torus may assume. This can be formed easily in the process of making the device, and any particular configuration may be obtained from a practical standpoint.

As to the getter, various materials may be used such as processed barium azide, barium metal or sintered metal. Further, if radiation characteristics of species other than the rare gas is required, this species can be generated by thermal decomposition of $UrH_3$, $UrD_3$, $KMnO_4$, $LiN_3$, $ZnCO_3$, $CuSO_4.nH_2O$, $AuCl_3$, $AuI_3$, and $AuBr_3$ or as disclosed in the referenced patents.

The heater can take many configurations and is schematically illustrated as a simple electric heater. However, it would preferably be a metal-film-on-plastic or ceramic resistor with a heat conducting material held in place by means such as a teflon shrink sleeve and/or an outer-inner insulating layer held in place by a second teflon shrink sleeve. Any means which accomplishes the thermal decomposition is satisfactory, but selection would be governed primarily by size and weight.

It is obvious that any type of structural support may be used for retaining the device of the present invention in position, so long as it does not affect the electrical characteristics or block the gas or the discharge in the torus.

The above description and drawings are illustrative only since equivalents may be substituted for various components described. Accordingly, the invention is to be limited only by the scope of the following claims.

I claim:

1. A photoionizer comprising a light source comprising:

a hollow torus;

a UV or VUV transmitting window in said torus, said window comprising part of the inner wall of said torus;

a gas filling within said torus, said gas filling being at a pressure between $10^{-3}$ and $10^{3}$ torr;

means for creating an electrical discharge within said torus;

means for passing a preselected gas sample through the passage in said torus;

means within said passage through said torus for collecting or extracting the ions and electrons produced by the light from said light source striking said gas sample; and means connected to said means within said passage for measuring the ions and electrons collected by said electrode means.

2. The photoionizer of claim 1 wherein said gas filling contains at least one rare gas.

3. The photoionizer of claim 1 wherein said gas filling contains at least two rare gases.

4. The photoionizer of claim 1 wherein said gas filling contains at least one rare gas and one halogen containing compound.

5. The photoionizer of claim 1 wherein a getter is enclosed in a side arm attached to the envelope.

6. The photoionizer of claim 1 wherein a getter and a thermal decomposition source of a gas in separate arms are attached to the envelope with means for heating the decomposition source.

7. The photoionizer of claim 1 wherein the UV or VUV window consists of material selected from the list of $CaF_2$, $MgF_2$, LiF, quartz and purified $SiO_2$.

8. The photoionizer of claim 1 wherein the enclosure is formed from a dielectric.

9. The photoionizer of claim 8 wherein the dielectric consists of a glass or an alkali metal resistant glass.

10. The photoionizer of claim 8 wherein the dielectric consists of material selected from the list of quartz, purified $SiO_2$, Pyrex, 1720 glass, 1723 glass and Gehlinite.

11. The photoionizer of claim 1 wherein the window is sealed to the dielectric by a sealing compound.

12. The photoionizer of claim 11 wherein the sealing compound consists of a material selected from the list of an epoxy resin, Silvac, AgCl/Ag and a low melting sealing glass.

13. The photoionizer of claim 1 wherein said means for creating an electrical discharge is an electrode connected to a high AC potential and a second ground electrode, both of said electrodes being adjacent to or on the exterior of said dielectric enclosure.

14. The photoionizer of claim 13 wherein the frequency of the AC field is between 50 KHz and 5000 MHz.

15. The photoionizer of claim 13 wherein at least one of said electrodes is semi-transparent.

16. The photoionizer of claim 15 wherein said semi-transparent electrode is a metal grid or a metal helix.

17. The photoionizer of claim 15 wherein said semi-transparent electrode is a thin metal coating.

18. The photoionizer of claim 13 wherein said electrodes are located at either end of the dielectric enclosure and exterior to the hole in the torus so as to cause a discharge in said torus.

19. The photoionizer of claim 13 wherein said means for creating an electrical discharge are two non-transparent electrodes connected to a source of high voltage AC potential.

20. The photoionizer of claim 1 wherein said electrode means comprises a semi-transparent electrode adjacent to said UV or VUV window, and a thin wire extending along the axis of said torus at least the length of said semi-transparent electrode.

21. The photoionizer of claim 1 wherein at least one of the ion and electron collecting or extracting electrodes are the same as at least one of the electrodes used to cause an electrical discharge within said envelope.

22. The photoionizer of claim 1 wherein the means for collecting the ions or electrons produced by the light from said torus consist of a helix of controlled resistivity material adjacent to the UV or VUV window, one end of which is connected to a source of current and the other end of which is connected to ground so that a uniform electric field is impressed along the axis of the photoionization region and sheet electrodes, permeable to the gas flow, such as metal grids, at either end of the helix with the one nearest the current source connected to that source and the one at the other end connected to ground via the input of an electrometer so that the current between it and the other electrodes can be measured.

23. The photoionizer of claim 22 wherein the potential reference point there used as ground can be any potential both positive or negative.

24. The photoionizer of claim 22 wherein the potential of the electrode connected to the helical electrode is at a positive or negative potential relative to that of the current source connected to the helical electrode.

25. The photoionizer of claim 1 wherein all ion or electron collection or extraction electrodes are at the high AC potential used to cause a discharge in said torus and the only potential gradient which exists between the electrodes are those imposed to collect ions and electrons.

26. The photoionizer of claim 1 wherein all ion or electron collection or extraction electrodes are at ground AC potential and another electrode adjacent to or in contact with the dielectric envelope is at a high AC potential.

27. The photoionizer of claim 22 and 25 wherein the helix is of a controlled resistivity material selected so that when the potential is applied across said helix for ion collection or extraction purposes, sufficient heat is generated to maintain the adjacent objects at a temperature sufficient to prevent deposition of material on them.

28. The photoionizer of claim 16 wherein the semi-transparent electrode is a grid or helix of material of controlled resistivity.

29. The photoionizer of claim 22 wherein the isolation of the discharge causing potential from the ion collection potentials is accomplished by inductive and capacitative impedances located at selected places in the connections to the various electrodes.

30. The photoionizer of claim 1 wherein the means for measuring ions and electrons comprises the electrode structure with either a DC or AC potential applied which is distinct from that causing a discharge in the dielectric enclosure, and an electrometer which measures the resulting current between said electrodes.

31. The photoionizer of claim 1 wherein the means for passing said gas sample through said passage consists of a pressure or density gradient substantially along the axis of the ion collection electrode structure.

32. The photoionizer of claim 1 wherein the source of AC voltage causing a discharge in said torus is contained in a conducting enclosure of one or more parts, which also contains the mounting of said torus such that electrical connections entering the conducting enclosure are decoupled from AC potential by filters, and the AC potentials confined within the conducting enclosure which has gas inlet and outlets so as to prevent the leaking of AC potentials.

33. The photoionizer of claim 1 wherein the AC potential exciting the discharge in said torus either is isolated from the electrodes collecting the ions caused by photoionization or is in phase on both such ion collection electrodes so that in the region of photoionization a potential gradient due to the said AC potential does not exist, and so that ions and electrons produced by photoionization do not cause further ionization by impact.

34. The photoionizer of claim 1 further comprising structure support consisting of a fixture through which a hole is made having two O-rings separated by a sleeve, and wherein the one at one end rests against a lip of smaller diameter in the fixture and the other is separated from it by a sleeve, and both are compressed by a washer or washer with insert which is mounted on the one face of the flange by screws which compress the washer and hence the O-rings onto the photoionization detector which is located partially inside the fixture with extensions extending outside of one or both ends.

35. The photoionizer of claim 1 wherein the mounting of said torus includes thermal insulation so that said torus is heated by the electrical discharge within it, but such that the exterior of the enclosure, adjacent to the insulation, is at electrical AC ground.

36. The photoionizer of claim 1 wherein the support of said torus includes thermal insulation and a heating element so that the temperature of the enclosure can be stabilized above room temperature to prevent deposition of compounds on the enclosure or its VUV window and such that the heating element is at AC ground.

37. The photoionizer of claim 7 wherein the thermal decomposition material consists of a material selected from the list of $UrH_3$, $UrD_3$, $KMnO_4$, $LiN_3$, $ZnCO_3$, $CuSO_4.nH_2O$, $AuCl_3$, $AuI_3$, and paladilic potasium salts of Cl, I, Br.

38. The photoionizer of claim 1 further comprising means for cleaning material in contact with the sample gas by reaction with a free radical.

39. The photoionizer of claim 38 wherein the free radicals are O or $O_3$.

40. The photoionizer of claim 38 wherein the free radicals are produced by photoionization.

41. The photoionizer of claim 28 wherein the free radicals are produced by an electrical discharge.

42. The photoionizer of claim 38 wherein the discharge occurs in the region containing the electrodes, the VUV window and a portion of said torus.

43. The photoionizer of claim 40 wherein the discharge occurs in the path of the gas sample and upstream from the ion collecting electrodes.

44. The photoionizer of claim 40 wherein the discharge occurs between electrodes placed external to the material determining the path of the sample gas through the electrode structure.

* * * * *